US007412941B2

(12) United States Patent
Mora et al.

(10) Patent No.: US 7,412,941 B2
(45) **Date of Patent: *Aug. 19, 2008**

(54) LIFEBOAT DISENGAGEMENT SYSTEM

(75) Inventors: Tony Mora, Julian, CA (US); Sidney Medley, Menifee, CA (US); Russell Tuckerman, Escondido, CA (US); Roger Lopez, El Cajon, CA (US)

(73) Assignee: Survival Systems International, Inc., Valley Center, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/539,152

(22) Filed: Oct. 5, 2006

(65) Prior Publication Data

US 2008/0083365 A1 Apr. 10, 2008

(51) Int. Cl.
*B63B 23/00* (2006.01)
*B66C 1/34* (2006.01)

(52) U.S. Cl. ..... 114/378; 294/82.27

(58) Field of Classification Search ..... 114/365
See application file for complete search history.

(56) References Cited

U.S. PATENT DOCUMENTS 1,246,468 A * 11/1917 Robinson ..... 114/380
1,742,092 A * 12/1929 Overman ..... 114/380
2,714,731 A * 8/1955 Binmore ..... 114/378
2,800,667 A * 7/1957 Staudt ..... 114/380
4,106,144 A 8/1978 Chabot
4,348,043 A 9/1982 Fandel
4,461,233 A * 7/1984 Nilsson ..... 114/378
4,822,311 A 4/1989 Doerffer et al.
D310,058 S 8/1990 Thompson et al.

* cited by examiner

*Primary Examiner*—Jesús D Sotelo
(74) *Attorney, Agent, or Firm*—David E. Heisey; Sheppard Mullin Richter & Hampton LLP

(57) ABSTRACT

The present invention provides a lifeboat disengagement system for supporting and releasing a twin fall lifeboat, the system comprising a single lifeboat release assembly and a pair of hook assemblies for releasable engagement with a corresponding pair of lifting links. The lifeboat disengagement system includes an engaged configuration wherein the lifting links are secured by the hook assemblies, and a disengaged configuration wherein the lifeboat release assembly is employed to release the lifting links from the hook assemblies simultaneously. The lifeboat disengagement system provides positive locking under load including a load over center design such that a load of the lifeboat is in line with a center of hook rotation, thereby preventing the hook from opening inadvertently and eliminating the need for a hydrostatic device.

19 Claims, 8 Drawing Sheets

LIFEBOAT DISENGAGEMENT SYSTEM

FIELD OF THE INVENTION

The present invention relates generally to hooking and engagement systems for lifeboats, and more particularly, to a lifeboat disengagement system for supporting and releasing twin fall lifeboats.

BACKGROUND OF THE INVENTION

In heavy industry, military and maritime situations, hooks are provided on a piece of equipment in order to make it more mobile, or to allow for it to be transferred from location to location. In these circumstances, large cranes are utilized, and the chain or cable of the crane is provided with a large loop or ring which is to be engaged with the piece of equipment to be moved. Depending upon the particular use, it may be desirable to have a hook which can be opened either under full load, or without load. One of the common forms of hook available in the industry is a type that, under load, can be opened by use of a long line or chain that actuates a releasing mechanism, and releases the hook when it is under load. The disadvantage of this form is that the hooks are not easy to set or release when not under load. In another form, the action of releasing of the load by placement or by other means automatically releases the hook, and thus terminates the connection between the cable and the device being lifted.

One particular use of this type of equipment is the support of lifeboats aboard ship and on drilling platforms. Lifeboats may comprise enclosed boats that are used on commercial vessels, cruise ships, and off-shore platforms. Twin fall lifeboats are supported by a pair of cables on hoists so that they may be loaded or entered and quickly lowered over the side of a ship or off the side of a platform. Vessels of this type have particular need for a hook locking mechanism which cannot be released under load without substantial inconvenience and the requirement of conscious and deliberate steps to manually release the locking mechanism. This is accomplished by disengaging the coupling to the manual release drive means (e.g., a hand crank for driving the release mechanism) and stowing it in a location separate from the lock release drive mechanism.

Changes in lifeboat launching arrangements have been characterized by slow evolution driven by regulatory change. One change that is particularly relevant was the introduction by the International Maritime Organization (IMO) in 1986 of a regulatory requirement for on-load release hooks. Prior to this time, after lowering a boat into the water, it was necessary manually to unhook the boat from its falls. As boats and their launching gear became larger and heavier, this task had become fraught with danger as crew tried to complete a simultaneous (fore-and-aft) unhooking process. The requirement for on-load release hooks was introduced to overcome these problems, in the expectation that launching would become significantly safer. In practice, on-load release hooks have brought their own problem, with accidents being reported sufficiently frequently for a clear picture to emerge about the types of failure and range of consequences (in terms of seafarer injuries and fatalities) that typically occur. The well-known nature of the problem is illustrated by the publication of two industry surveys. The first was compiled in 1994 by the Oil Companies International Marine Forum (OCINF), based on a questionnaire distributed via the International Chamber of Shipping and selected Flag State Administrations. A total of 92 incidents were identified, 41% of which resulted in injury, with 2 incidents leading to fatalities.

OCIMF also noted a lack of confidence amongst mariners leading to reluctance to conduct lifeboat drills. Recommendations were addressed to ship owners, manufacturers and authorities (including the IMO), and it is therefore to be assumed that these various organizations were made aware of the survey findings.

Accident reports make it clear that most accidents to date have occurred during routine drills, maintenance and testing. During these activities, it is usually only members of the ship's crew who are at risk should an accident occur. It also appears that few lifeboat accidents in recent times have occurred during use of the lifeboat in earnest in an emergency abandon ship scenario. The occurrence of serious accidents involving lifeboat on-load release hooks, resulting in injury to or death of seafarers, is an ongoing problem in the shipping industry. Such confidential incident reports highlight both the mechanical problems associated with lifeboat launching arrangements and the resulting lack of confidence amongst seafarers about their safety during lifeboat drills. However, it is evident from the various reports of lifeboat accidents that those involving unexpected or unintended release of the suspension hooks are likely to be the most serious accidents, often leading to fatalities. Preventing or minimizing the occurrence of "hook" accidents would therefore make a major contribution to risk reduction.

In many cases, the failure of on-load hooks is not so much of the hook itself, but more a failure of the release mechanism. To understand the significance of this it is necessary to understand how a typical on-load release hook functions. FIG. 1 (Prior Art) illustrates the working parts of a conventional on-load hook design. Many other manufacturers' designs are believed to operate on equivalent or similar principles. The opening part of the hook may rotate about a swivel pin, which is supported by two side plates of the hook (shown by the long solid line which loops around the top of the swivel pin). The weight of the boat is supported by these side plates, which exert a downward force on the swivel pin. The force is opposed by the tension in the falls, transmitted to the opening part of the hook via the suspension ring. The circular cross section of the suspension ring is seen in the bight of the hook, with an upward force arrow labeled "Hook's load". The weight of the boat acting downwards at the center of the swivel pin, together with the load in the falls acting upwards at the center of the suspension ring, creates a couple, or an equal and opposite pair of forces acting parallel to each other. This couple tends to rotate the hook in a counter-clockwise direction to open the hook. However, this tendency to open is prevented by the cam.

With further reference to FIG. 1 (Prior Art), the cam comprises a semi-circular shape, wherein an upper part of this cam prevents the hook rotating in a counter-clockwise direction. The cam can rotate about a center of rotation marked "+" in the figure which also shows the hook's tail force pushing on the cam. There is an equal and opposite reaction force from the cam pushing on the tail of the hook. This reaction force acts in a clockwise direction on the hook, balancing the counter-clockwise tendency created by the weight of the boat. The lowest part of the tail of the hook lies above the cam's center of rotation such that if the cam is rotated clockwise around this center, the cam will no longer be in contact with the tail of the hook. Under the influence of a counter-clockwise couple, the hook will open and fall away. Clockwise rotation of the cam is achieved by means of a downwards pull on the cable causing rotation of the cam crank. The cable is connected to the operating lever located adjacent to the coxswain's position in the boat. Since the tail of the hook lies above the cam's center of rotation, the hook's tail force exerts a turning moment on the cam which tends to rotate the cam in a clockwise direction. If allowed to occur, this rotation results in release of the hook. Only the positioning of the cam crank, as dictated by the cable and operating lever, prevents the hook forcing itself open under the action of the couple generated by the boat's weight and tension in the falls.

The above description of the hook design illustrates that many on-load hook designs are inherently "unstable" because the weight of the boat suspended on the hook tends to produce a hook opening effect, which has to be resisted by the operating mechanism for the hook to stay closed. Thus the operating mechanism (lever, cable and cam crank) serves not only to release the boat when required, but also to maintain the hook closed at all other times. Any deficiency in the operating mechanism impacts directly on the ability of the hook to remain closed and support the boat. Thus, many on-load release hooks currently in use are inherently unsafe.

A well-known problem exists with respect to unstable hooks in twin fall lifeboats. This problem was studied in detail by the Maritime and Coastguard Agency (MCA), which concluded that many existing on-load release hooks are inherently unsafe and therefore unfit for use with twin fall lifeboats. The study determined that lifeboat accidents occur for a number of reasons, and that most of the more serious accidents (particularly those involving fatalities), occur because of problems with the on-load release hooks. For example, through the premature or unexpected opening of one or both hooks during a routine test or drill, the lifeboat either becomes suspended vertically or drops completely into the water, frequently resulting in injuries and/or fatalities.

Unsafe situations often arise because many on-load hooks have a tendency to open under the effect of the lifeboat's own weight and need to be closed using an operating mechanism. As a result, there is no defense against: (1) defects/faults in the operating mechanism; (2) errors by the operator; or (3) incorrect resetting of the hook after being released. The MCA concluded that unstable hooks are the primary reason for almost all serious accidents involving lifeboats, and that the solution lies in a radical re-design of the hook types involved. In addition, the MCA recommended that all on-load release hooks be designed and constructed to be stable (i.e., self-closing) when supporting the weight of the lifeboat. Moreover, the MCA suggested that unstable designs of on-load release hooks are identified with the intention that they be withdrawn from service on all ships and urgently replaced with stable designs.

SUMMARY OF THE INVENTION

In view of the foregoing, it is an object of the present invention to provide a lifeboat disengagement system that provides positive locking under load, the system featuring a pair of stable hooks, wherein the load of the lifeboat locks the hooks such that they do not release under load.

One aspect of the present invention involves a lifeboat disengagement system for supporting and releasing a twin fall lifeboat, the system comprising a single lifeboat release assembly and a pair of hook assemblies for releasable engagement with a corresponding pair of lifting links. The lifeboat disengagement system includes an engaged configuration wherein the lifting links are secured by the hook assemblies, and a disengaged configuration wherein the lifeboat release assembly is employed to release the lifting links from the hook assemblies simultaneously. The lifeboat disengagement system provides positive locking under load including a load over center design such that a load of the lifeboat is in line with a center of hook rotation. In accordance with the principles of the invention, the lifeboat disengagement system provides positive locking under load until the lifeboat release assembly is used to disengage the hook assemblies simultaneously. The hook assemblies feature stable hooks such that the load of the lifeboat locks the hooks such that they do not release under load. An operator may pull a hook release lever of the lifeboat release assembly and open the hooks once the lifeboat is afloat in water.

According to one implementation of the invention, each hook assembly comprises a hook that is positioned between a pair of plates by way of a shaft such that the hook is capable of rotating about the shaft, the hook including an engaging surface that is provided with a predetermined arcuate shape. In some embodiments of the invention, the plates include a release surface which is vertically extended and curved relatively toward a rearward portion of the hook. The release surface acts to positively disengage the hoisting ring held by the hook during disengagement. The system further comprises a counter weighted safety latch for maintaining the engagement between the hook and the hoisting ring. In particular, the hook is engaged with the hoisting ring by passing the hoisting ring between the hook and the counter weighted safety latch, overcoming the counter weight, and after engagement, the counter weighted safety latch returns back to its original closed position, such that a distal end of the counter weighted safety latch is in close proximity to a distal end of the hook.

Another aspect of the present invention involves a lifeboat disengagement system for supporting and releasing a twin fall lifeboat, comprising a single lifeboat release assembly and a pair of hook assemblies for releasable engagement with a corresponding pair of lifting links, wherein each hook assembly comprises a hook that is positioned between a pair of plates by way of a shaft such that the hook is capable of rotating about the shaft, wherein the lifeboat disengagement system includes an engaged configuration, wherein the lifting links are secured by the hook assemblies, and wherein the lifeboat disengagement system includes a disengaged configuration, whereby the lifeboat release assembly is employed to release the lifting links from the hook assemblies simultaneously. In the system, the hook includes a joint for connecting the hook to a first end of a push rod, a second end of the push rod is attached to a first end of a flexible cable, and a second end of the flexible cable is attached to the lifeboat release assembly.

According to an embodiment of the invention, the lifeboat release assembly comprises a housing, a release handle, first and second release links, and a pull plate connected to a pair of flexible cables, which are connected to respective hook assemblies. The lifeboat disengagement system provides positive locking under load until the lifeboat release assembly is used to disengage the hook assemblies simultaneously. In accordance with the principles of the invention, the hook assemblies feature stable hooks, the load of the lifeboat locks the hooks such that they do not release under load, and an operator may pull a hook release handle of the lifeboat release assembly and open the hooks once the lifeboat is afloat in water.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings, in which.

DETAILED DESCRIPTION OF THE PREFERRED EMBODIMENTS

Figure 1:
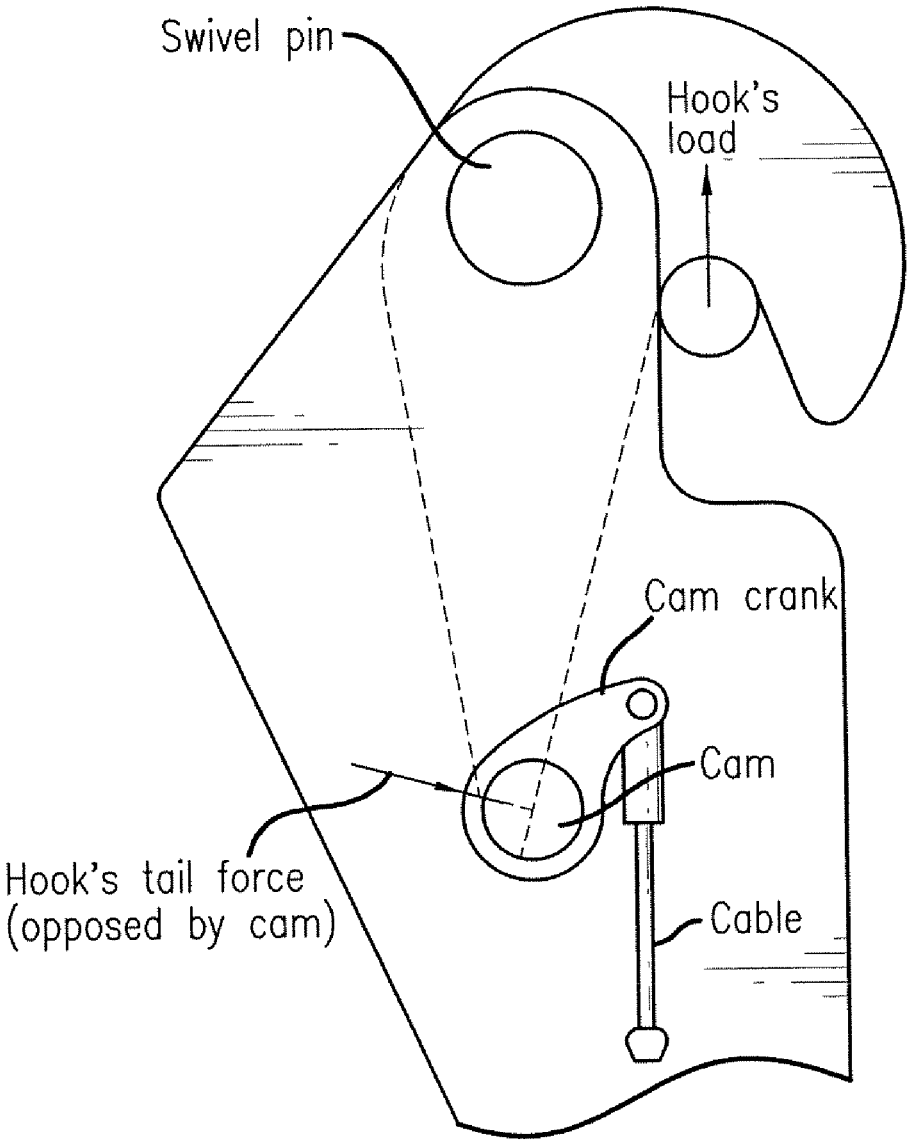
FIG. 1 PRIOR ART
FIG. 1 (Prior Art) is a perspective view of a conventional on-load hook design

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

The present invention is directed to a lifeboat disengagement system for supporting and releasing twin fall boats, wherein the disengagement system provides positive locking under load until a release handle is pulled that disengages a pair of hooks simultaneously. Unlike conventional systems, the lifeboat disengagement system of the present invention features a pair of stable hooks, wherein the load of the lifeboat locks the hooks such that they do not release under load. In other words, the disengagement system is designed so the load of the boat is not employed to open the hook. This locking design protects the occupants of the boat while it is being lowered into the water or while it is being lifted out of the water. Even if an operator, in error, attempts to pull on the hook release lever while the boat is suspended in the air, the stable hooks will not open. In addition, should a part fail or malfunction, the hooks will not open. Once the boat is afloat in the water, the operator may then pull the hook release lever and open the hook.

According to the principles of the present invention, the stable hook design set forth herein permits the lifeboat floating in the water to replace, or to be used in lieu of, a troublesome conventional hydrostatic release valve. Advantageously, the hooks of the invention include less parts that conventional hooks, and are therefore less complex in design and easier to maintain. Additionally, the hooks offer the seafarer greater safety than that afforded by conventional hooks having a hydrostatic release valve. The hooks of the invention provide positive locking under load because of a load over center design, wherein the load is in line with the center of hook rotation, thereby preventing the hook from opening inadvertently and eliminating the need for a hydrostatic device. The hooks of the invention are also relatively simple to operate in that: (1) if the operator can pull the hook release handle and move it, the boat is safely in the water, afloat and the hooks will open; or (2) if the operator pulls on the hook release handle and cannot move it, the boat is suspended in the air and the hooks will not open.

Regulation requires that in an emergency the hook design provides an ability to release the hooks when under load. According to the invention, this is accomplished by manually installing an additional ratchet lever on an exterior nut. The hooks can be reloaded even in the locked condition. In the system of the invention, a pair of hooks is mounted on a top surface of a lifeboat. Each hook may include a housing comprising a metal plate manufactured or bolted to the lifeboat, wherein the housing is provided with an independent servicing or hoisting flange having a circular opening for attaching to and lifting of the lifeboat.

Each hook that is utilized as a connection between a hoist and the lifeboat is rotatably pinned between a pair of plates which form the housing. The housing may be provided with a covering to prevent environmental contamination or damage. The hook includes an engaging surface that contacts the cable or hoisting ring. Specifically, the engaging surface includes the shaped portion of the hook, and is positioned such that, upon release and rotation of the hook, the face of the housing assists in the positive disengaging of the ring from the hook. A lock may be provided and positioned, such that in a released configuration, the lock either contacts or comes very close to contacting a distal end of the hook, thereby preventing the ring from accidentally being separated from the hook. In addition, a biasing device is positioned such that the securing function can be overcome easily by pressure during inserting of the ring, but cannot be overcome by the reverse motion.

According to the invention, each hook has a pivot point positioned such that the engaging surface for the hook and the housing cooperate to produce a vertical relationship between the pivot point of the hook and the contact point of the attaching ring with the hook surface. The engaging surface may be dimensioned such that the surface forms a constant radius arc, independent of rotation of the hook, about the pivot point of the hook. In operation, the hook is placed in its locked position, and a ring is placed through the exposed portion of the hook. The over center link position locks the structure preventing the hook from becoming disengaged upon accidental loss of tension in the cable supporting the ring and the remaining portions of the apparatus are locked in position by placing of a load on the ring. The links tend to remain in their extended condition under the load until such time as the load becomes sufficiently small such that the operator may pull the release handle such that the hooks disengage from the rings contained therein.

Figure 2:
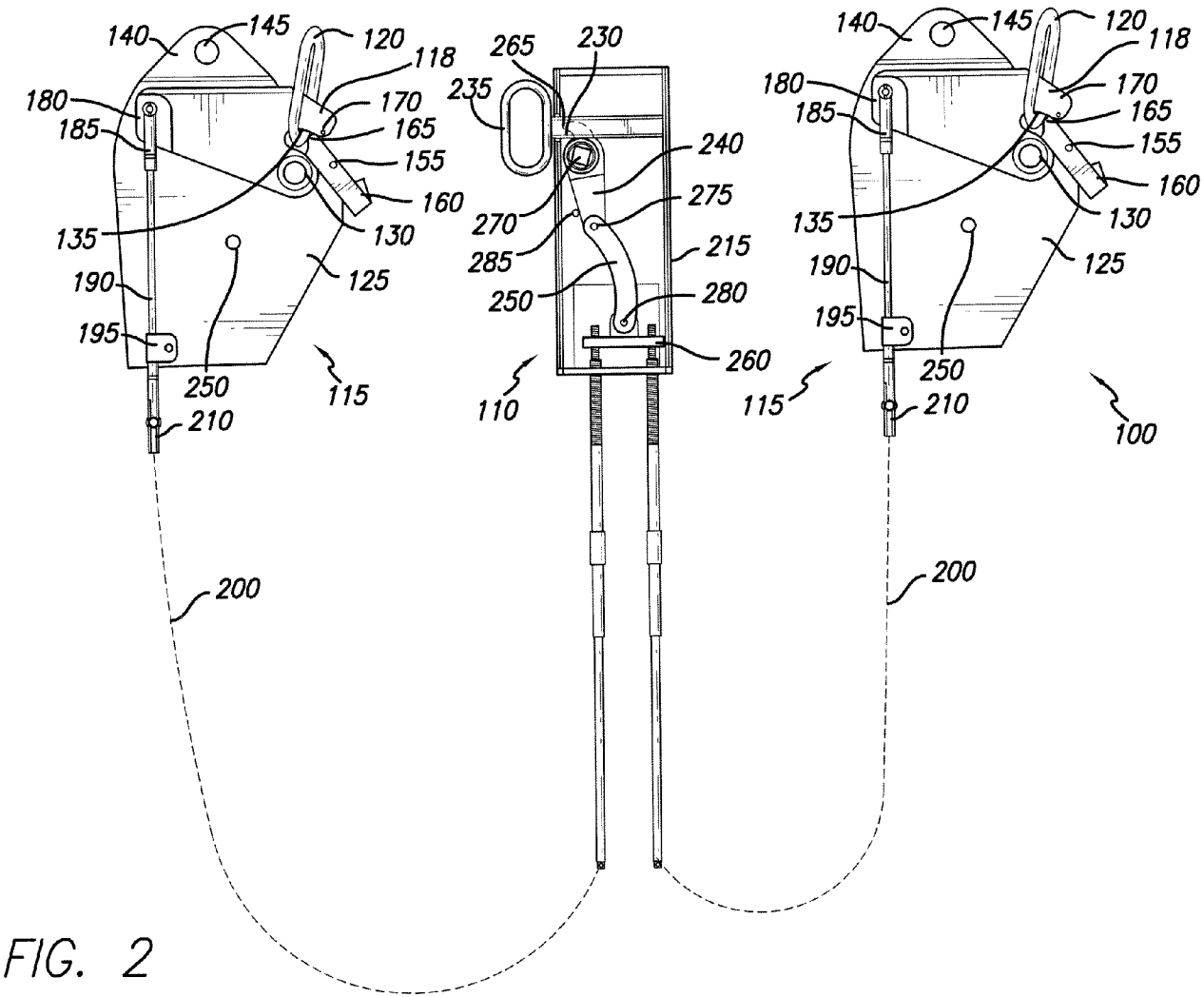
FIG. 2 is a schematic view of a lifeboat disengagement system in an engaged configuration, in accordance with the principles of the present invention.
Figure 3:
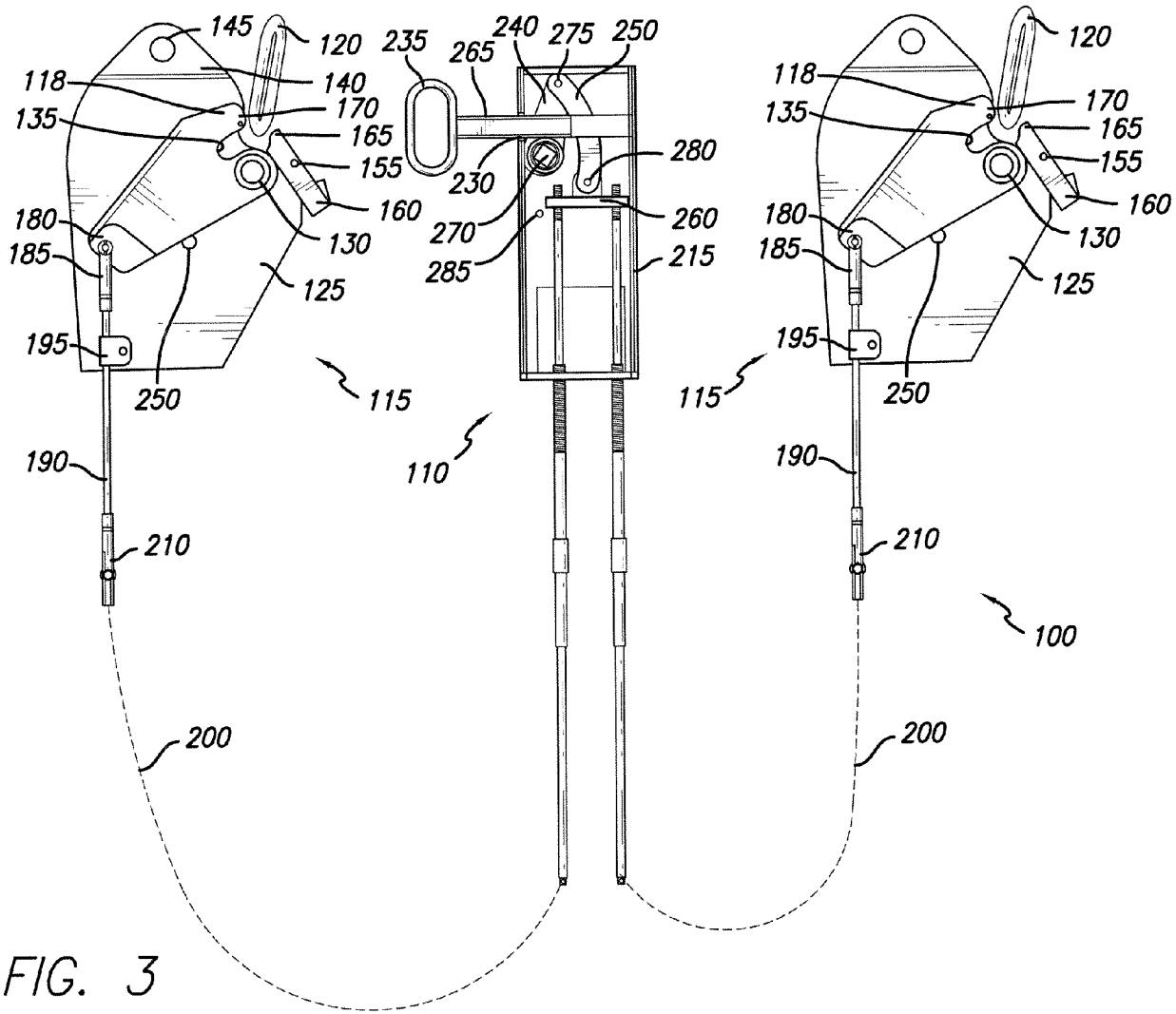
FIG. 3 is a schematic view of the lifeboat disengagement system of FIG. 2 in a disengaged configuration, in accordance with the principles of the present invention.

Referring to FIGS. 2-6, a preferred lifeboat disengagement system 100 for supporting and releasing twin fall lifeboats is illustrated. In particular, FIG. 2 depicts the lifeboat disengagement system 100 in an engaged configuration, wherein a pair of lifting links 120 are secured by corresponding hook assemblies 115, whereas FIG. 3 depicts the lifeboat disengagement system 100 in a disengaged configuration, wherein a single lifeboat release assembly 110 has been employed to release the lifting links 120 from the hook assemblies 115 simultaneously. The lifeboat disengagement system of the invention provides positive locking under load including a load over center design such that a load of the lifeboat is in line with a center of hook rotation.

Figure 4:
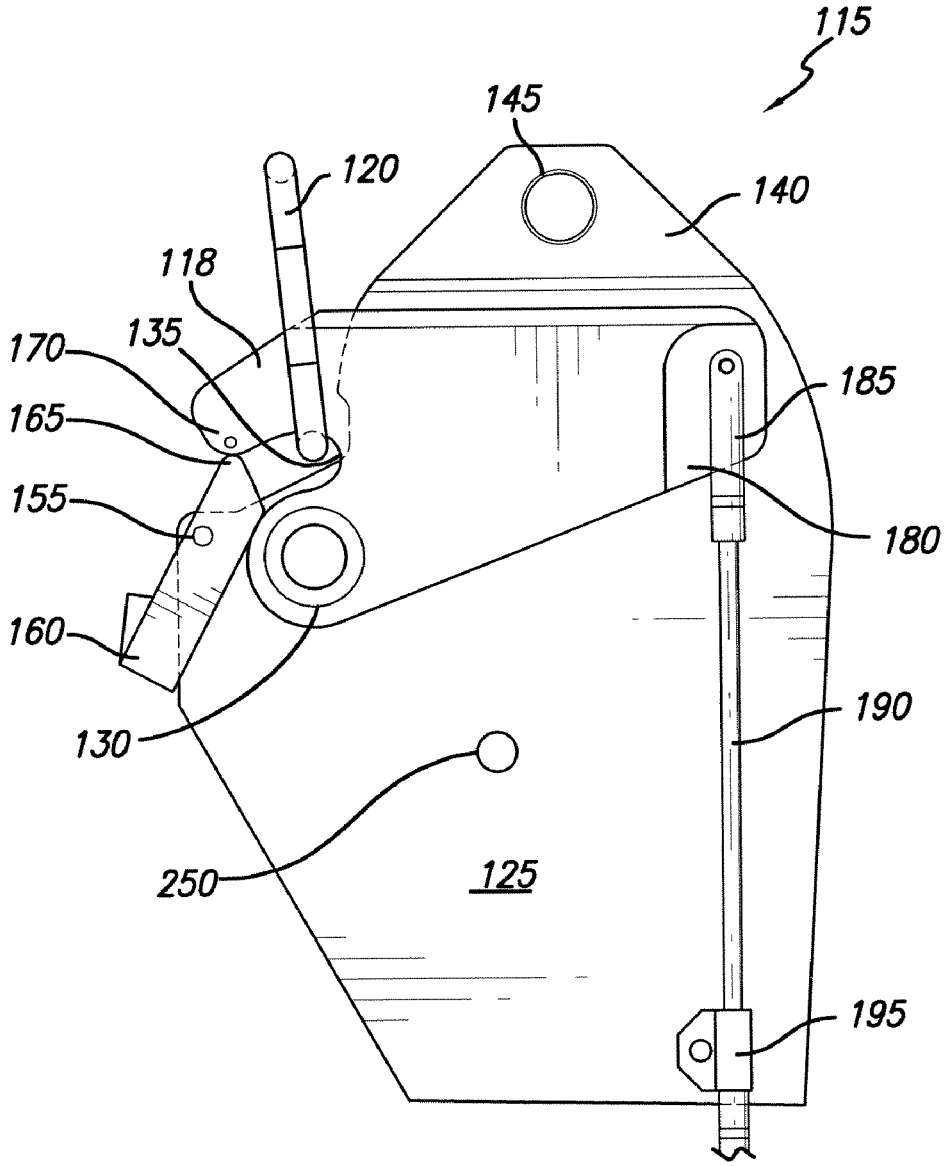
FIG. 4 is an enlarged view of a hook assembly of the preferred lifeboat disengagement system of FIG. 2 shown in the engaged configuration.
Figure 5:
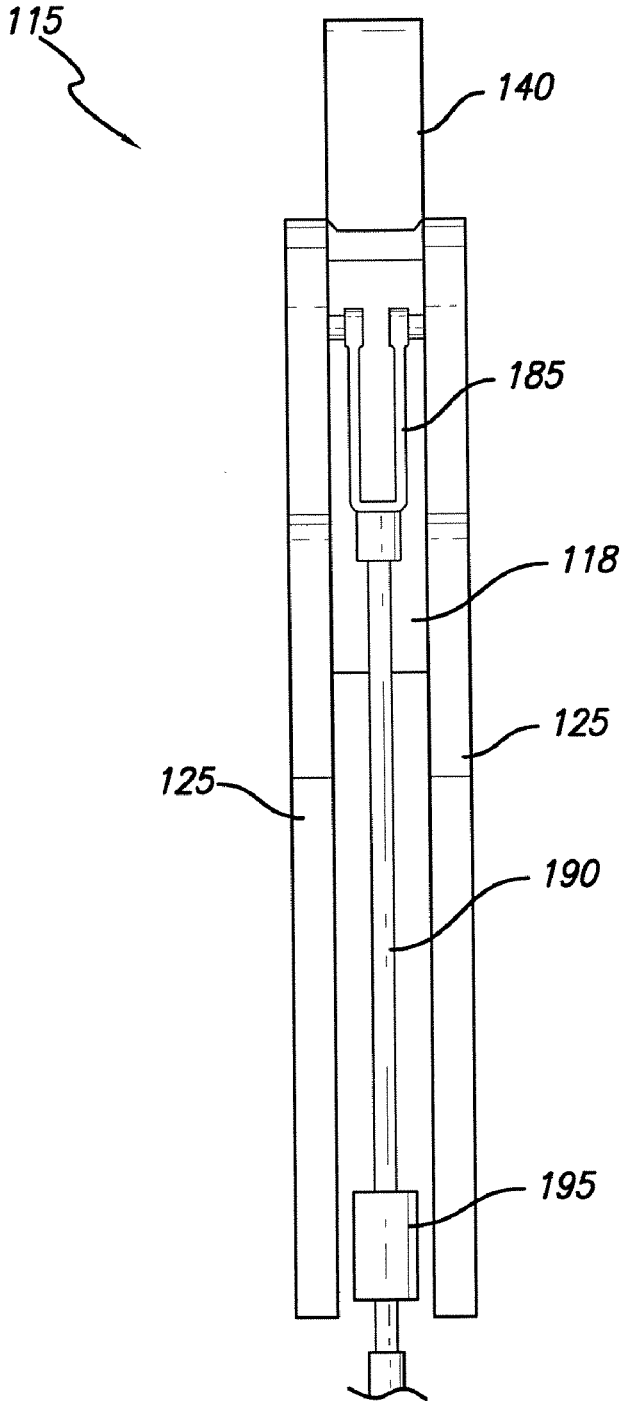
FIG. 5 is an end view of the hook assembly of FIG. 4.
Figure 6:
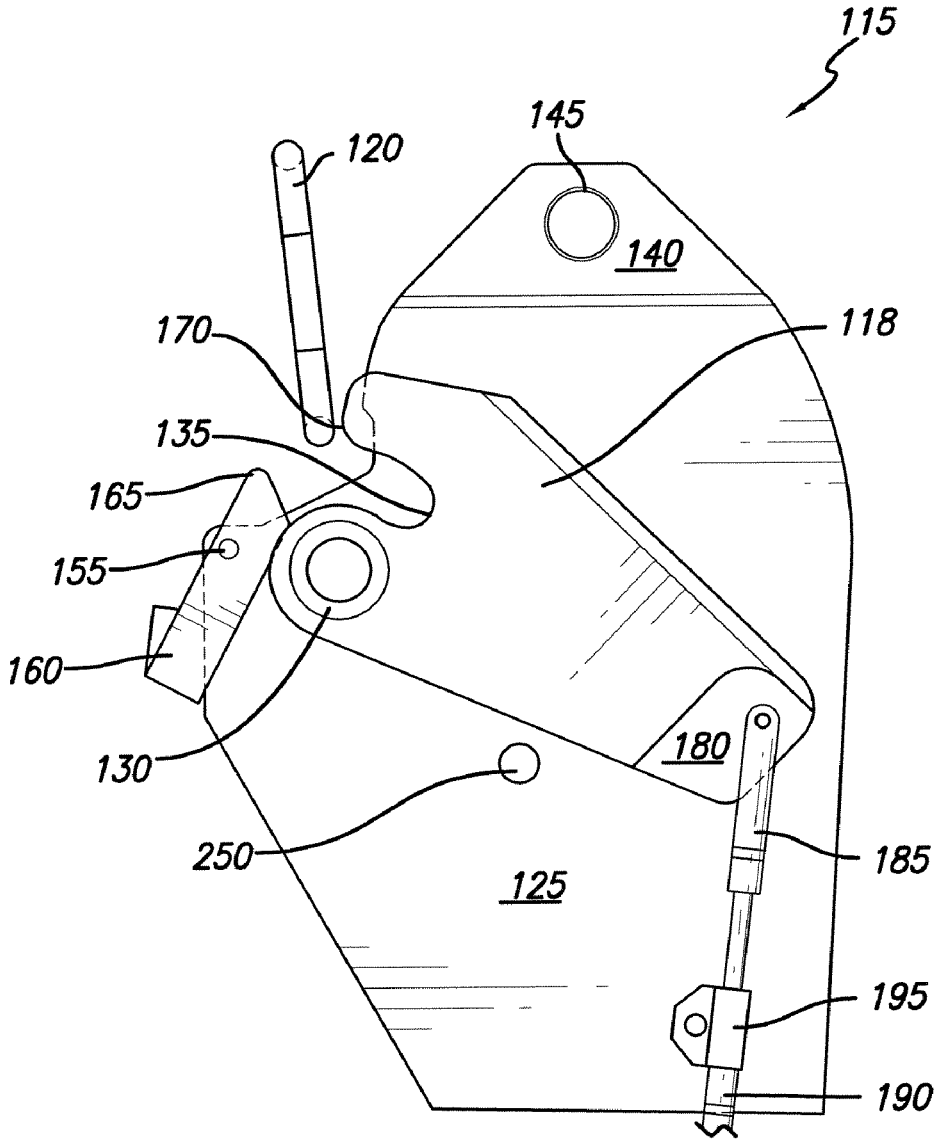
FIG. 6 is an enlarged view of a hook assembly of the preferred lifeboat disengagement system of FIG. 3 shown in the disengaged configuration.

FIG. 4 illustrates an enlarged view of a hook assembly 115 of FIG. 2 in the engaged configuration, while FIG. 5 depicts an end view of the hook assembly 115 of FIG. 4. FIG. 6 illustrates an enlarged view of a hook assembly 115 of FIG. 3 in the disengaged configuration showing the positioning of the hook 118 between the two plates 125. The disengagement system 100 provides positive locking under load until the lifeboat release assembly 110 is used to disengage the hook assemblies 115 simultaneously. The hook assemblies 115 feature stable hooks, wherein the load of the lifeboat locks the hooks such that they do not release under load (i.e., load of the lifeboat is not employed to open the hook). Once the boat is afloat in the water, the operator may then pull the hook release handle and open the hook.

The lifeboat disengagement system 100 of the invention may be employed for a variety of purposes such as moving and servicing lifeboats and other equipment. In operation, the lifeboat release assembly 110 is used to disengage the lifting links 120 simultaneously from stable hooks 118 of corresponding hook assemblies 115. More particularly, each hook assembly 115 comprises a hook 118 that is positioned between a pair of vertical plates 125 (which form a housing) by way of a shaft 130 such that the hook 118 is capable of rotating about the shaft 130. According to some embodiments, the housing may be provided with a covering to prevent environmental contamination or damage. The hook 118 includes an engaging surface 135 that is provided with a predetermined shape. In the illustrated embodiment, the engaging surface 135 is arcuate and is formed at a substantially constant radius from the shaft 130. The engaging surface 135 is positioned such that the face of the housing assists in the positive disengaging of the hoisting ring 120 from the hook 118 upon release and rotation of the hook 118.

One or both of the plates 125 is provided with an extension 140 which is drilled to form a lifting eye 145 suitable for hauling, hoisting or otherwise positioning the lifeboat or other equipment attached to the hook assembly 115. Each plate 125 is provided with a release surface which is vertically extended and curved relatively toward the rearward portion of the hook 118. During disengagement, the release surface 150 acts to positively disengage the hoisting ring 120 or other structure held by the hook 118 on its engaging surface 135. Additionally, each plate 125 is drilled at its forward end, and a pin 155 is provided for rotatably connecting a counter weighted latch 160. In the engaged configuration depicted in FIGS. 2 and 4, the hook 118 is engaged with the hoisting ring 120 by passing the ring 120 between the hook 118 and the counter weighted safety latch 160, overcoming the counter weight. The counter weight then biases the safety latch 160 back to its substantially closed position, such that a distal end 165 of the safety latch 160 is in close proximity to a distal end 170 of the hook 118. The entire hook assembly 115, with the exception of the hook and latch structure, may be covered with an enclosure (not depicted) to protect it from the elements, for example when used on board a ship.

With further reference to FIG. 2, the hook 118 is supported by the plates 125, and the shaft 130 rotatably mounts the hook 118 between the plates 125. The hook 118 is illustrated in its engaged configuration, with the pin 155 positioning the counter weighted safety latch 160. The hook 118 extends to form a rearward structure 180 including a joint 185 for connecting the hook 118 to one end of a flexible push rod 190. By way of example, the joint 185 may comprise a clevis to allow articulation and unhindered movement in any direction without binding. The hook assembly 115 further comprises a pivot assembly 195 attached in between the plates 125, and including a substantially cylindrical portion dimensioned for the passage of the push rod 190. The other end of the push rod 190 is attached to one end of a flexible cable 200 by way of a hinge 210 to allow articulation there between. The other end of the flexible cable 200 is attached to the lifeboat release assembly 110 including housing 215.

In FIG. 2, the lifeboat release assembly 110 is in its normal position such that the lifting links 120 remain engaged with the hooks 118, whereas in FIG. 3, the lifeboat release assembly 110 has been activated. In particular, a release handle 235 of the lifeboat release assembly 110 has been pulled by an operator such that the flexible cables 200 have been pulled, thereby releasing the lifting links 120 from the hooks 118. I the illustrated embodiment, the release handle 235 is substantially ring-shaped, which permits the lifeboat release assembly 110 to be more easily retrofitted. The lifeboat release assembly 110 includes housing 215, release handle 235, a semicircular banana link 230, first and second release links 240, 250, and a pull plate 260 connected to the flexible cables 200. The release handle 235 is connected via a pivot 265 to the banana link 230, which is attached to the housing 215 via a boss 270. The first release link 240 is attached to the boss 270 at one end, and at the other end, is attached to the second release link 250 via a pivot 275. The second release link 250 is attached to the pull plate 260 by pivot 280. By pulling the release handle 235, the banana link 230 is rotated about boss 270 in a counterclockwise direction, which causes the first release link 240 to pivot in the same direction about boss 270, thereby causing an upward displacement of the first release link 240. In turn, this causes an upward displacement of the second release link 250 and the pull plate 260, thereby pulling the flexible cables 200.

According to a preferred implementation, the lifeboat release assembly 110 is disposed inside the lifeboat such that the release handle 235 is an internal device. Existing lifeboats may be retrofitted by installing the lifeboat disengagement system 100 of the invention with limited modification to the existing lifeboat structure. Additionally, less motion is required to open and close the hooks 118. Specifically, the linear motion of the handle is converted to the rotary motion of the links, and then back to the linear motion of the pull plate 260. According to some embodiments, the release handle 235 must only be pulled approximately 4 inches to fully open the hooks 118. All moving parts of the lifeboat release assembly 110 are contained within the housing 215, thus preventing the interference of moving parts. If the operator is able to pull the hook release handle 235 and move it, then the lifeboat is safely afloat in the water, and the hooks 118 will open. However, if the operator pulls on the hook release handle 235 and cannot move it, then the lifeboat is suspended in the air and the hooks 118 will not open. To close the hooks to the normal position illustrated in FIG. 2, the operator pushes the release handle 235 until the second releaselink 240 abuts stop pin 285.

Referring to FIG. 3, when an operator pulls the handle 235 of the lifeboat release assembly 110, the release arm 230, 240 is forced to rotate in a counter-clockwise direction about boss 270. This rotation causes an upward displacement of the second portion 240 of the release arm 230, 240, thereby pulling both of the flexible cables 200 and causing the push rods 190 to be pulled in a substantially downward direction. The downward displacement of each push rod 190 within its pivot assembly 195, in turn, causes the hook 118 to rotate in a clockwise direction about its shaft 130. As illustrated in FIG. 3, the rotation of the hook 118 causes the distal end 170 of the hook 118 to be displaced away from the distal end 165 of the safety latch 160, thereby releasing the hoisting ring 120. Further clockwise rotation of the hook 118 is prevented by a stop 250.

Figure 7:
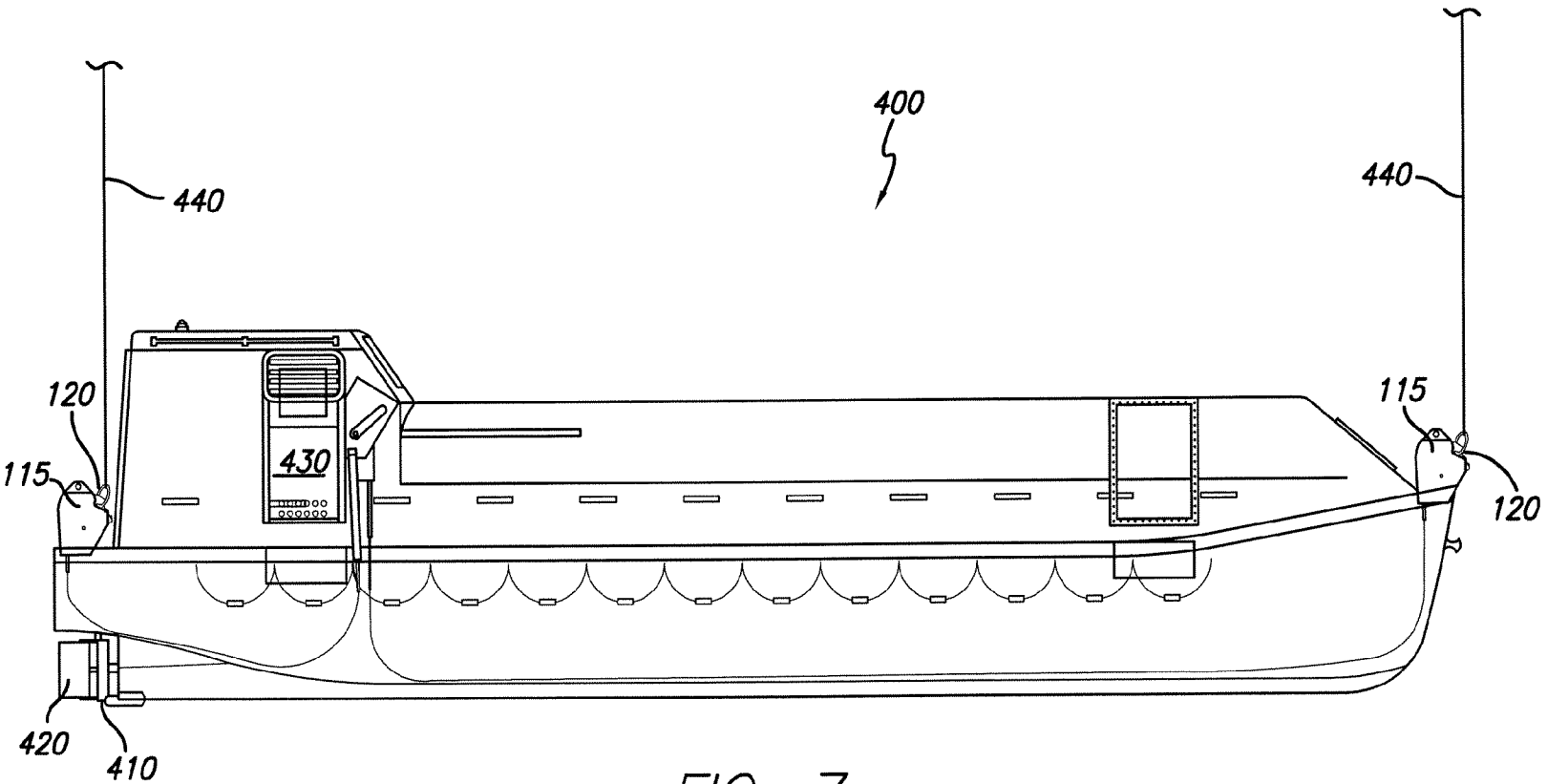
FIG. 7 is a side view of an exemplary lifeboat that is provided with a pair of hook assemblies, in accordance with the principles of the invention.

Referring to FIG. 7, an exemplary lifeboat 400 is provided with a pair of hook assemblies 115 on an upper surface of the lifeboat 400. The lifeboat 400 includes a propeller 410 and a rudder 420, and can be entered through a hatch 430 approached from the decking. In operation, a lowering device (not shown) may be employed to lower the lifeboat 400 into the water using a pair of cables 440 having lifting links 120 that are releasably attached to corresponding hook assemblies 115. Once the lifeboat 400 is in the water, the lifting links 120 are released from the hook assemblies as described hereinabove. After use, the lowering device may be used to lift the lifeboat 400 out of the water.

Figure 8:
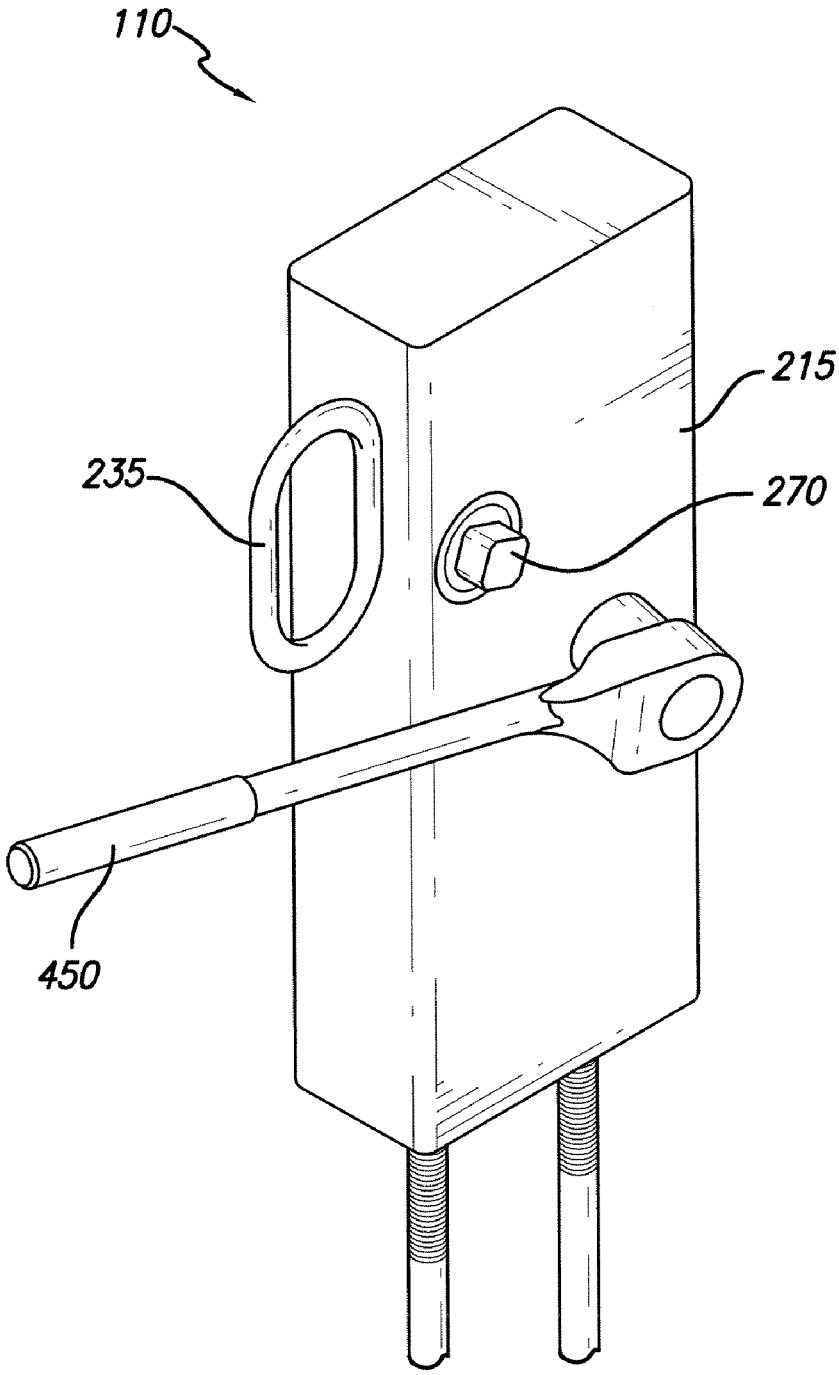
FIG. 8 is a perspective view of the lifeboat release assembly FIGS. 2 and 3 further comprising an emergency ratchet handle that permits the hooks to be released under load.

Referring to FIG. 8, according to some embodiments of the invention, the lifeboat release assembly 110 of FIGS. 2 and 3 further comprises an emergency ratchet handle 450 that permits the hooks 118 of the invention to be released under load. In other words, a lifeboat (such as exemplary lifeboat 400 illustrated in FIG. 7) may be released in an emergency situation, for example when the lifeboat is suspended only a few feet above the water and the hooks 118 will not otherwise release. In such a situation, an operator may employ the emergency ratchet handle 450 to rotate the boss 270 (which protrudes from housing 215) in a counterclockwise direction to overcome the load and drop the lifeboat 400 into the water. Using the emergency ratchet handle 450 in this fashion achieves the same mechanical effect as pulling the handle 235 in that it causes the boss 270 to rotate in a counterclockwise direction, thereby causing the hooks 118 to release the corresponding lifting links 120.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A lifeboat disengagement system for supporting and releasing a twin fall lifeboat, comprising:

a single lifeboat release assembly; and a pair of hook assemblies for releasable engagement with a corresponding pair of lifting links;

wherein the lifeboat disengagement system includes an engaged configuration, wherein the lifting links are secured by the hook assemblies;

wherein the lifeboat disengagement system includes a disengaged configuration, whereby the lifeboat release assembly is employed to release the lifting links from the hook assemblies simultaneously;

wherein the lifeboat disengagement system provides positive locking under load including a load over center design such that a load of the lifeboat is in line with a center of hook rotation; and wherein the hook assembly includes hooks that are configured to release when under load.

2. The system of claim 1, wherein the load over center design prevents the hook from opening inadvertently and eliminates the need for a hydrostatic device.

3. The system of claim 1, wherein:

the hook assemblies feature stable hooks; and a load of the lifeboat locks the hooks such that they do not release under load.

4. The system of claim 3, wherein an operator may pull a hook release lever of the lifeboat release assembly and open the hooks once the lifeboat is afloat in water.

5. The system of claim 1, wherein each hook assembly comprises a hook that is positioned between a pair of plates by way of a shaft such that the hook is capable of rotating about the shaft.

6. The system of claim 5, wherein the hook includes an engaging surface that is provided with a predetermined arcuate shape.

7. The system of claim 5, wherein the plates include a release surface which is vertically extended and curved relatively toward a rearward portion of the hook.

8. The system of claim 7, wherein the release surface acts to positively disengage a hoisting ring held by the hook during disengagement.

9. The system of claim 5, further comprising a counter weighted retainer which captures a lifting link before a load is applied.

10. The system of claim 9, wherein:

the hook is engaged with the lifting link by passing a hoisting ring between the hook and the counter weighted retainer, overcoming the gravity of the counter weight; and after engagement, the counter weighted retainer returns to its original closed position, such that a distal end of the counter weighted retainer is in close proximity to a distal end of the hook.

11. A lifeboat disengagement system for supporting and releasing a twin fall lifeboat, comprising:

a single lifeboat release assembly; and a pair of hook assemblies for releasable engagement with a corresponding pair of lifting links;

wherein each hook assembly comprises a hook that is positioned between a pair of plates by way of a shaft such that the hook is capable of rotating about the shaft;

wherein the lifeboat disengagement system includes an engaged configuration, wherein the lifting links are secured by the hook assemblies;

wherein the lifeboat disengagement system includes a disengaged configuration, whereby the lifeboat release assembly is employed to release the lifting links from the hook assemblies simultaneously;

wherein the lifeboat disengagement system provides positive locking under load including a load over center design such that a load of the lifeboat is in line with a center of hook rotation; and wherein the hook assembly includes hooks that are configured to release when under load.

12. The system of claim 11, wherein:

the hook includes a joint for connecting the hook to a first end of a push rod;

a second end of the push rod is attached to a first end of a flexible cable; and a second end of the flexible cable is attached to the lifeboat release assembly.

13. The system of claim 11, wherein the lifeboat release assembly comprises a housing, and a release handle.

14. The system of claim 11, wherein the lifeboat release assembly comprises a housing, a release handle, first and second release links, and a pull plate connected to a pair of flexible cables, which are connected to respective hook assemblies.

15. The system of claim 14, wherein the load over center design prevents the hook from opening inadvertently and eliminates the need for a hydrostatic device.

16. The system of claim 11, wherein:

the hook assemblies feature stable hooks;

a load of the lifeboat locks the hooks such that they do not release under load; and an operator may pull a hook release handle of the lifeboat release assembly and open the hooks once the lifeboat is afloat in water.

17. The system of claim 11, wherein:

the hook includes an engaging surface that is provided with a predetermined arcuate shape;

the plates include a release surface which is vertically extended and curved relatively toward a rearward portion of the hook; and the release surface acts to positively disengage a hoisting ring held by the hook during disengagement.

18. The system of claim 11, further comprising a counter weighted release for maintaining the engagement between the hook and the hoisting ring.

19. The system of claim 18, wherein:

the hook is engaged with the lifting link by passing a hoisting ring between the hook and the counter weighted safety latch, overcoming the gravity of the counter weight; and after engagement, the counter weighted release returns to its original closed position, such that a distal end of the counter weighted release is in close proximity to a distal end of the hook.

* * * * *